US007307242B1

(12) United States Patent
Chen

(10) Patent No.: US 7,307,242 B1
(45) Date of Patent: Dec. 11, 2007

(54) HEATING DEVICE OF A GLOVE

(75) Inventor: Chien-Chou Chen, Jiali Township, Tainna County (TW)

(73) Assignee: MEC Addheat Company, Tainan (TW)

( * ) Notice: Subject to any disclaimer, the term of this patent is extended or adjusted under 35 U.S.C. 154(b) by 0 days.

(21) Appl. No.: 11/473,232

(22) Filed: Jun. 23, 2006

(51) Int. Cl.
*H05B 1/00* (2006.01)

(52) U.S. Cl. ..... 219/211; 219/494; 219/529; 219/548; 219/549

(58) Field of Classification Search ..... 219/211, 219/528, 529, 549, 545, 527, 494, 548
See application file for complete search history.

(56) References Cited

U.S. PATENT DOCUMENTS 4,950,868 A * 8/1990 Moss et al. ..... 219/211
6,239,410 B1 * 5/2001 Tackore ..... 219/211

FOREIGN PATENT DOCUMENTS

CA 1145427 * 3/1997

* cited by examiner

*Primary Examiner*—Tu Ba Hoang
*Assistant Examiner*—Leonid Fastovsky
(74) *Attorney, Agent, or Firm*—Rosenberg, Klein & Lee

(57) ABSTRACT

A heating device includes a warming member, a battery set, and a control mechanism; the warming member consists of a sheaf of highly resistant filaments, and several spaced-apart conductive wires, which are positioned among, wrapped in, and connected in series to the sheaf of highly resistant filaments; front and rearmost ones of the conductive wires are connected to a battery set, and a control mechanism is connected to the battery set for controlling electric current provided by the battery set; the highly resistant filaments will serve as warming portions of the warming member; the warming portions of the warming member are arranged on inner lateral sides of front portions of finger portions of a glove such that when one wears the glove, the warming portions will be on two lateral sides of first and second sections of the wearer's fingers.

10 Claims, 7 Drawing Sheets

HEATING DEVICE OF A GLOVE

BACKGROUND OF THE INVENTION

1. Field of the Invention

The present invention relates to a heating device of a glove, more particularly one, which includes several warming portions on inner sides of finger portions of a glove for warming front portions and tips of a wearer's fingers, and which consumes relatively little electric energy.

2. Brief Description of the Prior Art

People have to wear gloves and more clothes to protect them from frostbite in cold weather. Conventional gloves can keep the wearer warm because they have isolative function, capable of slowing down the speed of cold passing onto the wearer's hands and heat of the wearer's hands traveling outside. However, such gloves can't produce heat, and the wearers' hands will still be very cold in cold weather if the wearers suffer from bad blood circulation.

To overcome the above-mentioned problem, a heating device of a glove is made available, which includes a warming layer over an inner side of a glove, and a battery set electrically connected to the warming layer. The warming layer can transform electric energy into heat therefore fingers of the wearer will be made warmer after the heating device is turned on.

Because the warming layer is positioned over the inner side of the glove, the heating device has a relatively high manufacturing cost, and the wearer will probably feel too hot and uncomfortable. Furthermore, the warming layer will consume relatively much electric energy. And, such a heating device isn't economical to use because only front ends of a person's fingers are prone to suffer from bad blood circulation usually, and need to be warmed in cold weather.

SUMMARY OF THE INVENTION

It is a main object of the invention to provide an improvement on a heating device of a glove to overcome the above-mentioned problems.

The heating device of the present invention includes a warming member, a battery set, and a control mechanism. The warming member consists of a sheaf of highly resistant filaments, and several spaced-apart conductive wires, which are positioned among, wrapped in, and connected in series to the sheaf of highly resistant filaments. Front and rearmost ones of the conductive wires are connected to a battery set, and a control mechanism is connected to the battery set for controlling electric current provided by the battery set. Thus, the highly resistant filaments will serve as warming portions of the warming member. The warming portions of the warming member are arranged on inner lateral sides of front portions of finger portions of a glove such that when one wears the glove, the warming portions will be on two lateral sides of first and second sections of the wearer's fingers. The heating device will consume relatively little electric energy because the warming portions are relatively small-sized.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
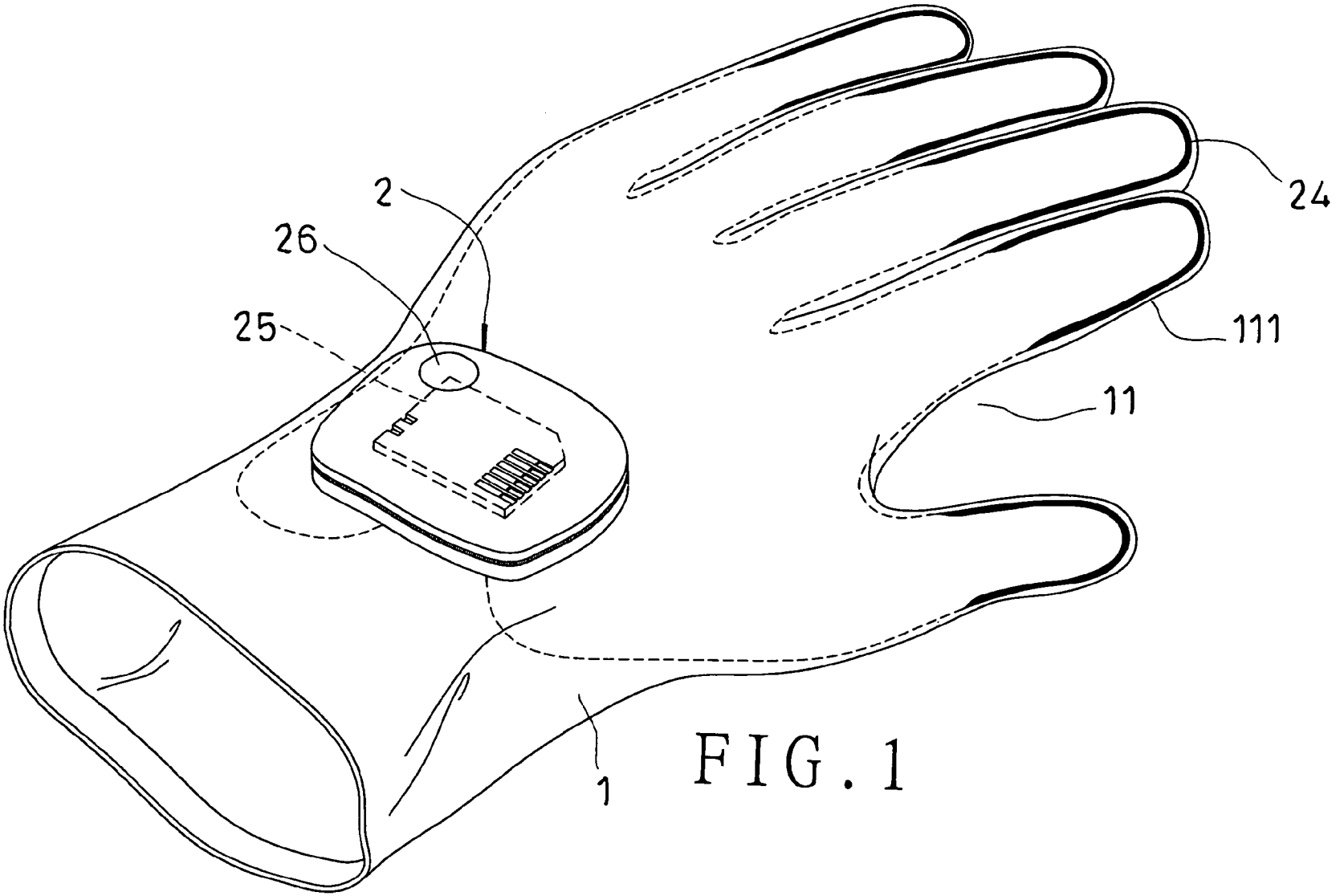
FIG. 1 is a perspective view of the present invention.
Figure 2:
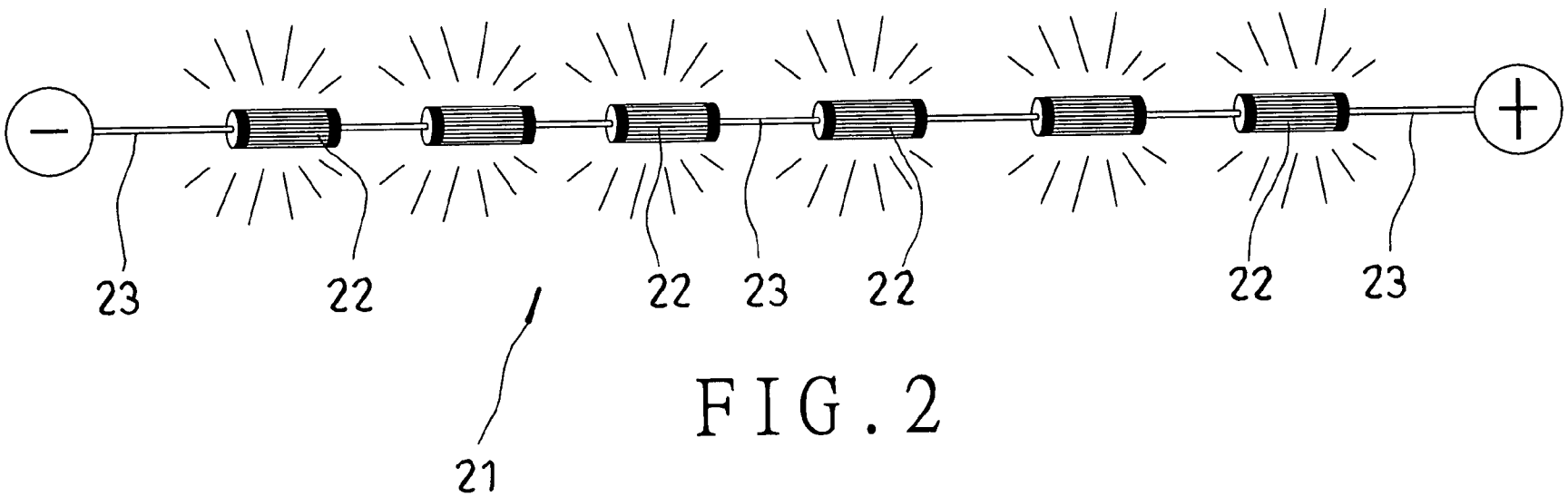
FIG. 2 is a partial perspective view of the first embodiment (1)
Figure 3:
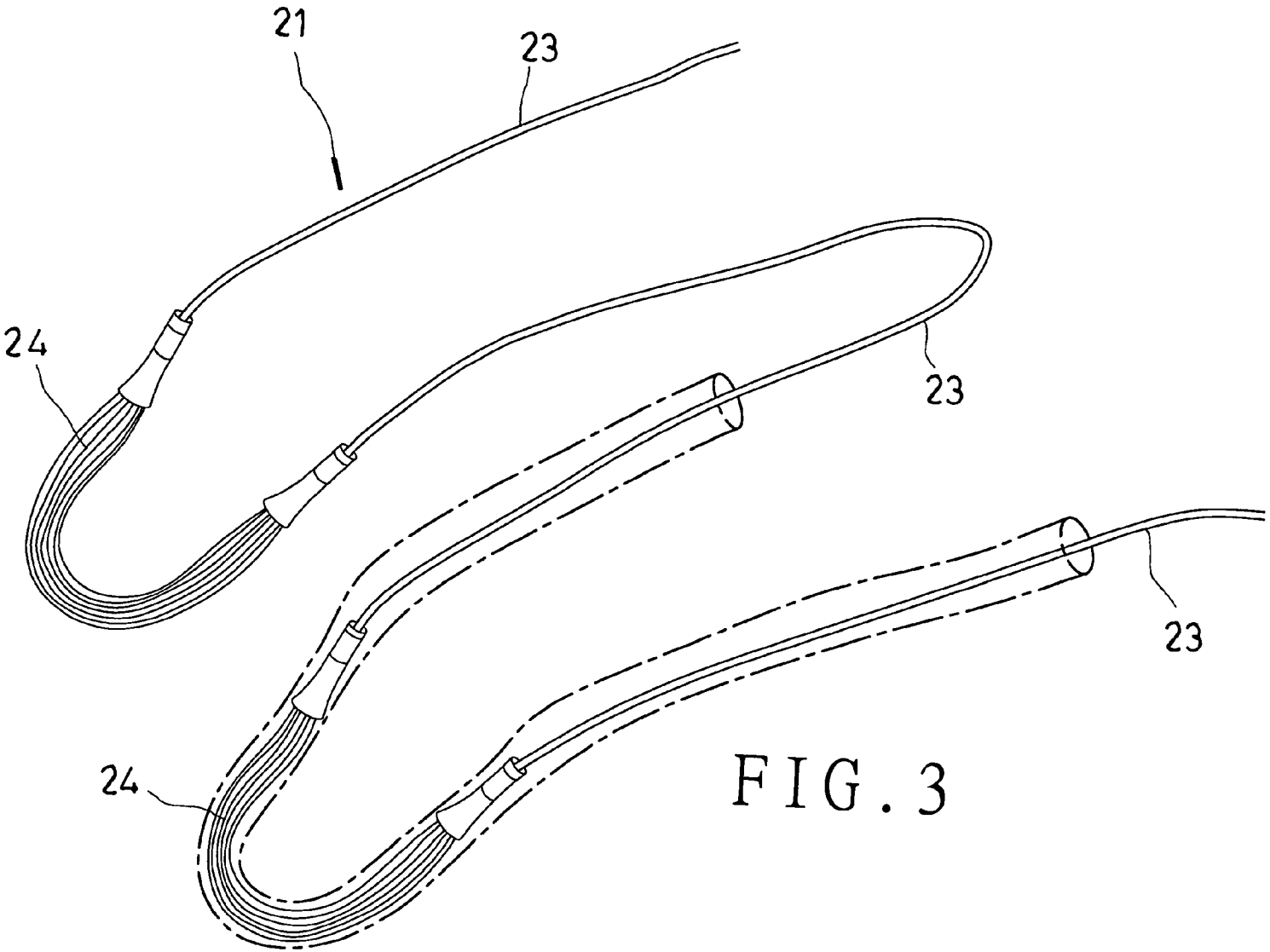
FIG. 3 is a partial perspective view of the first embodiment (2)

Referring to FIGS. 1 to 3, a first preferred embodiment 2 of a heating device of a glove includes a warming member 21, a battery set 25, and a control mechanism 26.

Figure 5:
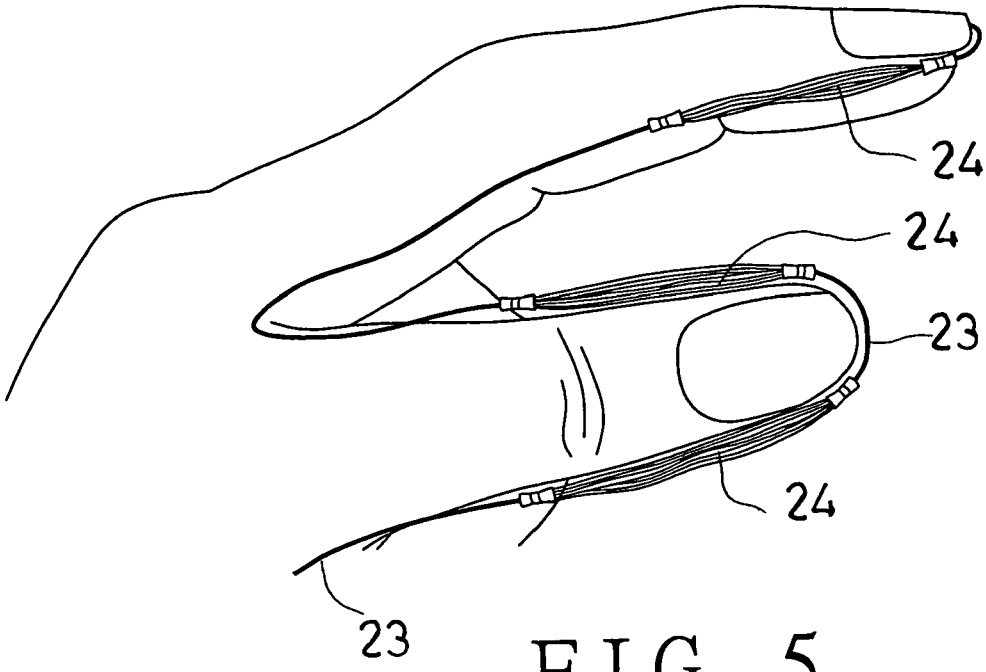
FIG. 5 is a partial perspective view of the first embodiment (4)

The warming members 21 are positioned on inner sides of finger portions 11 of a glove 1. The warming member 21 consists of several spaced-apart sheaves of highly resistant filaments 22, and several spaced-apart conductive wires 23 interposed between and connected in series to the highly resistant filaments 22. The highly resistant filaments 22 are preferably made of carbon fiber. The conductive wires 23 and the highly resistant filaments 22 are fastened together by means of welding or tying; thus, the highly resistant filaments 22 will serve as warming portions 24 of the warming member 21. The warming portions 24 of the warming member 21 can be arranged on inner lateral sides of front portions 111 of the finger portions 11 of the glove 1 such that when one wears the glove 1, the warming portions 24 will be on two lateral sides of front ends of the wearer's fingers, as shown in FIG. 5. Or alternatively, the warming portions 24 of the warming member 21 can be arranged on front ends of inner sides of the front portions 111 of the finger portions 11 of the glove 1 such that when one wears the glove 1, the warming portions 24 will be over front ends of the wearer's fingers, as shown in FIG. 4.

The control mechanism 26 is connected to the battery set 25 for controlling electric current provided by the battery set 25. And, front and rearmost ones of the conductive wires 23 are connected to the battery set 25. The battery set 25 and the control mechanism 26 are positioned on an outer side of the glove 1 for allowing the battery set 25 to be easily replaced as well as for allowing the control mechanism 26 to be operated.

Figure 4:
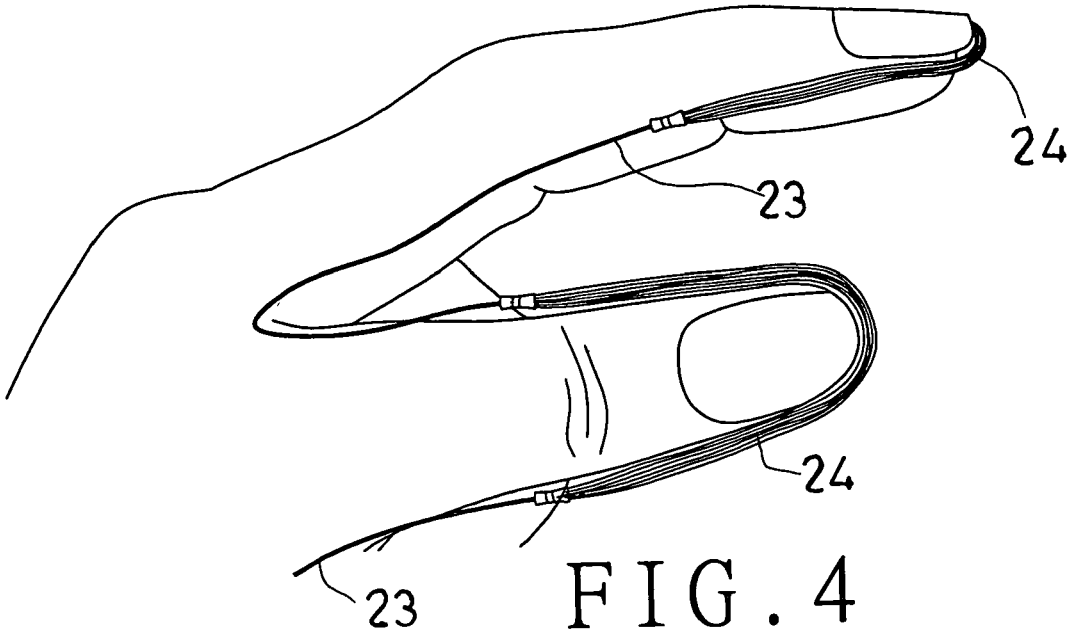
FIG. 4 is a partial perspective view of the first embodiment (3)
Figure 6:
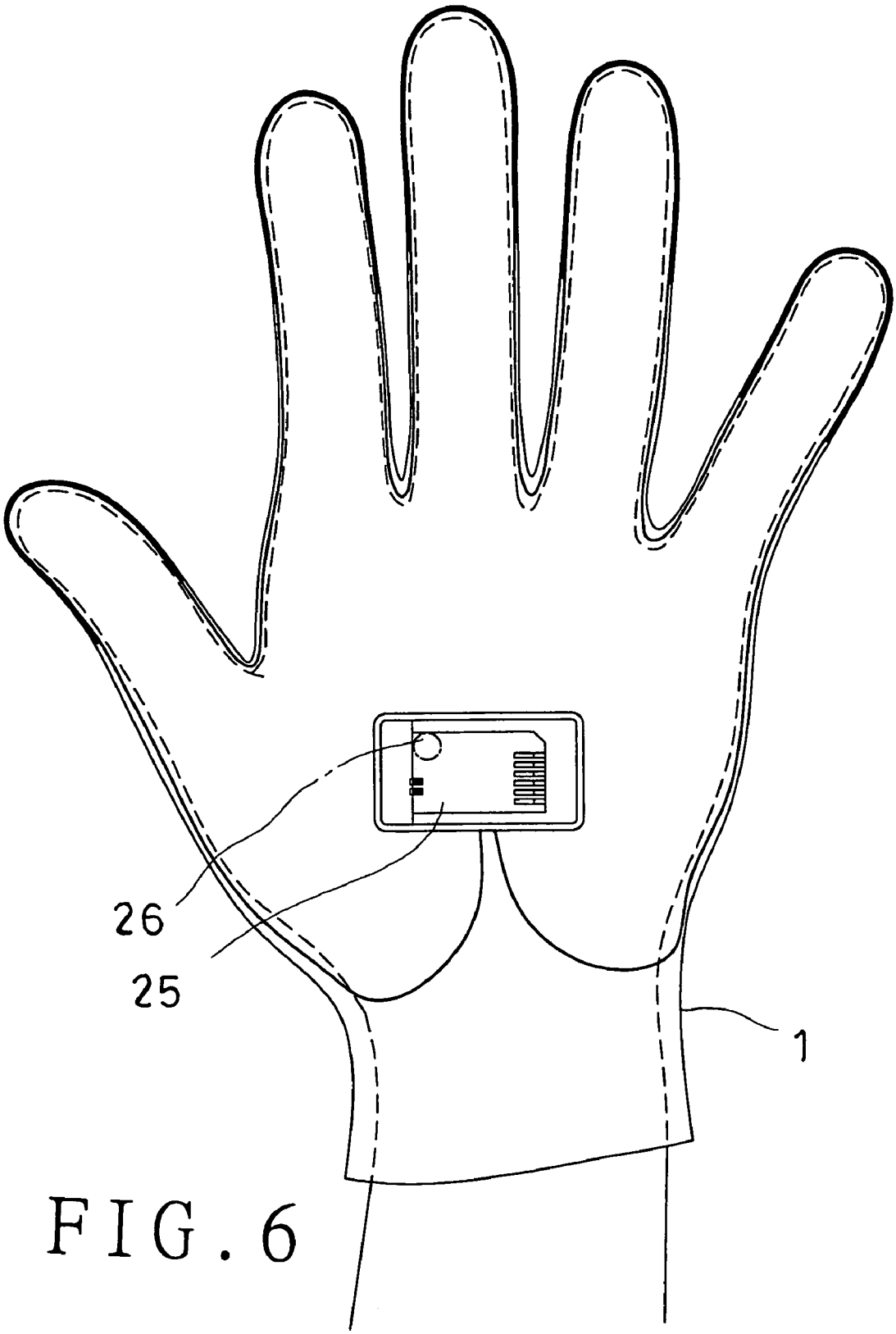
FIG. 6 is a view of the present invention, taken when it is in use.

Referring to FIGS. 4 to 6, when the heating device 2 is turned on, electric energy of the battery set 25 will pass through the warming portions 24 through the conductive wires 223 and transform into heat; thus, the front ends of the wearer's fingers are warmed. Consequently, the wearer's fingers are protected from very low temperature, which could cause discomfort or even frostbite. And, the wearer is allowed to adjust the temperature of the warming member 21 according to his need by means of using the control mechanism 26.

Figure 7:
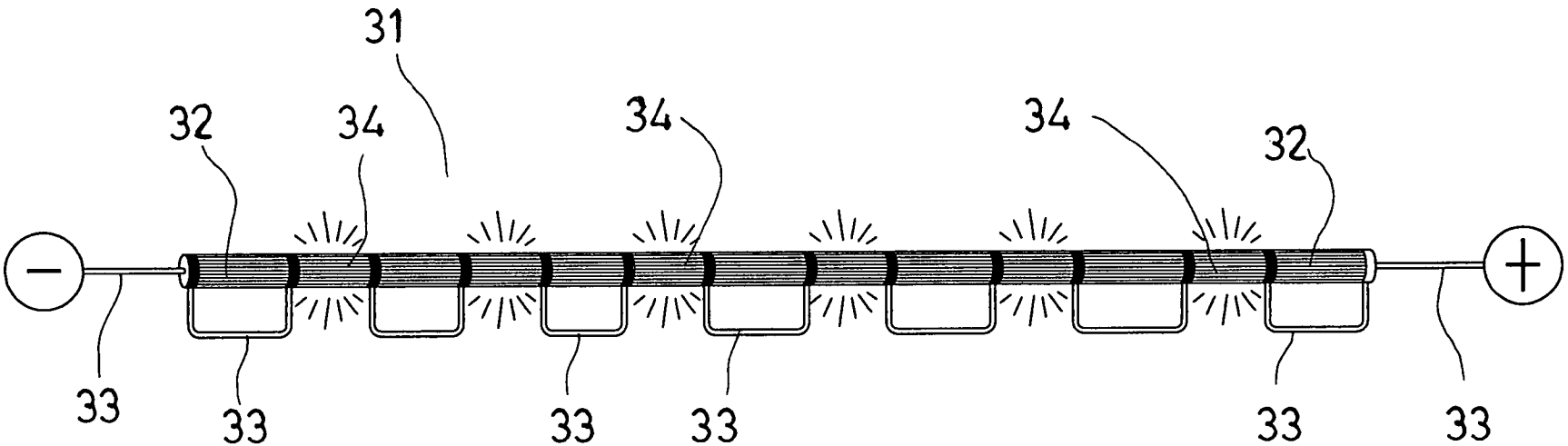
FIG. 7 is a partial perspective view of the second embodiment (1)
Figure 8:
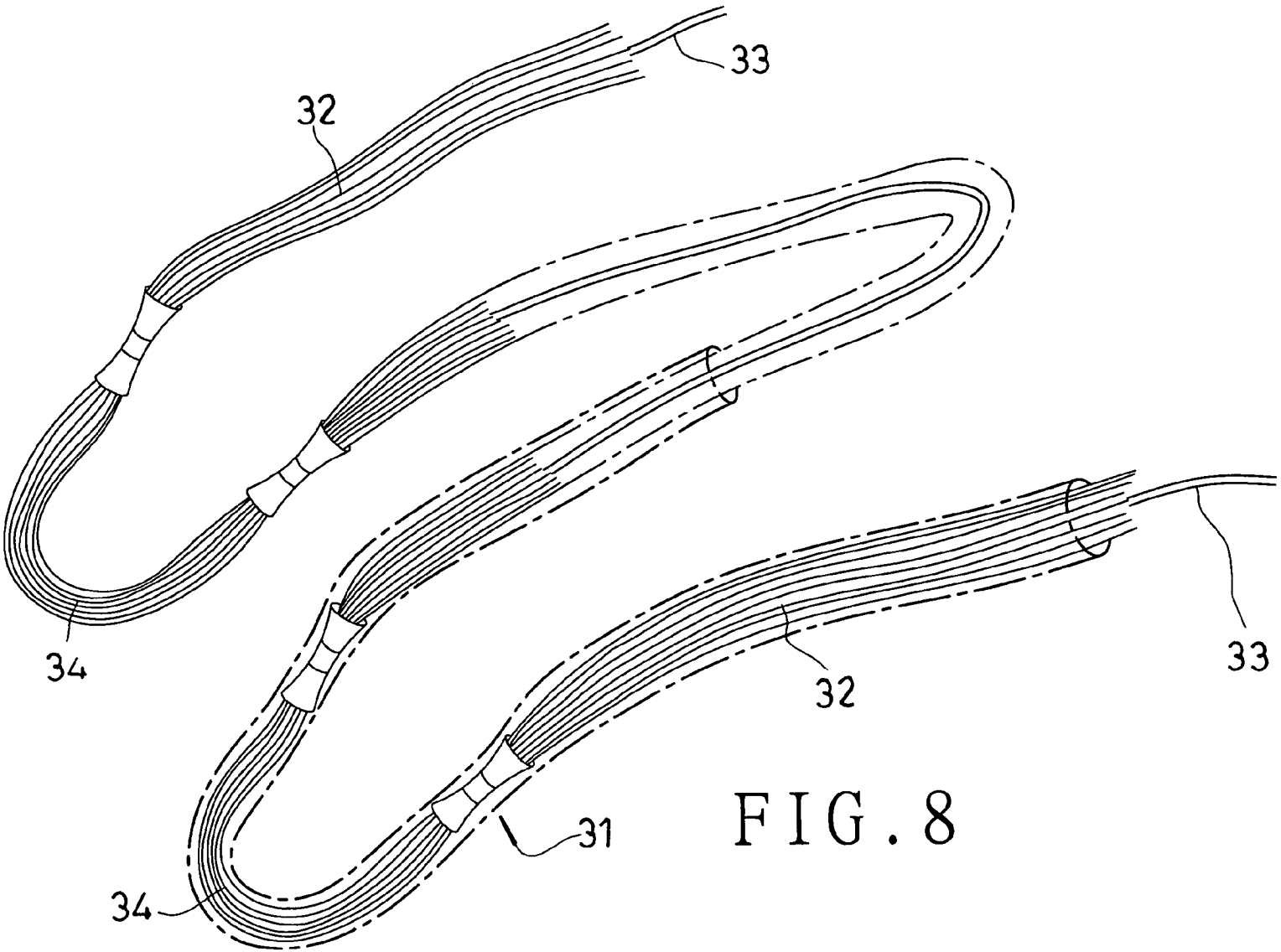
FIG. 8 is a partial perspective view of the second embodiment (2).

Referring FIGS. 1, 7, and 8, a second preferred embodiment of a heating device of a glove includes a warming member 31, a battery set 25, and a control mechanism 26.

The warming member 31 consists of a sheaf of highly resistant filaments 32, and several spaced-apart conductive wires 33, which are positioned among and wrapped in the sheaf of highly resistant filaments 22; thus, the conductive wires 33 won't touch the wearer's fingers, and the warming member 31 will touch the wearer's fingers more softly. Because the conductive wires 33 are wrapped in the sheaf of highly resistant filaments 22, they won't fall apart easily when subjected to pulling. Furthermore, front and rearmost ones of the conductive wires 33 are connected to a battery set 25, and a control mechanism 26 is connected to the battery set 25 for controlling electric current provided by the battery set 25. And, the conductive wires 33 and the highly resistant filaments 32 are connected together in series by means of welding or tying. Thus, the highly resistant filaments 32 will serve as warming portions 34 of the warming member 31. The warming portions 34 of the warming member 21 can be arranged on inner lateral sides of front portions 111 of finger portions 11 of a glove 1 such that when one wears the glove 1, the warming portions 34 will be on two lateral sides of first and second sections of the wearer's fingers. Or alternatively, the warming portions 34 can be arranged on front ends of inner sides of the front portions 111 of the finger portions 11 of the glove 1 such that when one wears the glove 1, the warming portions 34 will be over front ends of the wearer's fingers.

From the above description, it can be seen that the present invention has the following advantages:

1. The warming member of the heating device is positioned on inner sides of finger front portions of a glove for warming front ends of a wearer's fingers, which have relatively bad blood circulation as compared with other body parts, and are most easily affected by cold weather and frostbite. Therefore, the heating device of the present invention will consume relatively little electric energy as compared with the conventional ones, of which the warming members are positioned over an inner side of a glove.

2. The conductive wires are positioned among and wrapped in the highly resistant filaments therefore the wearer won't feel existence of the conductive wires, and the warming member of the heating device of the present invention will touch the wearer's fingers more softly.

3. The conductive wires are wrapped in and protected by the sheaf of highly resistant filaments therefore they won't fall apart easily when subjected to pulling.

What is claimed is:

1. A heating device for a glove having finger portions, comprising:

a warming member, said warming member having a plurality of warming portions including spaced-apart sheaves of highly resistant filaments, said resistant filaments having a plurality of conductive wires being interposed between each of said resistant filament thereby connecting said resistant filaments in series, the warming portions being arranged along an outer periphery of the contour of each finger portion of a glove for warming the front ends of a wearer's fingers.

2. The heating device for a glove as recited in claim 1, wherein the warming portions are arranged on front ends of inner sides of the finger portions of the glove.

3. The heating device for a glove as recited in claim 1, wherein the warming portions are located on two lateral sides of each finger portion.

4. The heating device for a glove as recited in claim 1, wherein the highly resistant filaments are made of carbon fiber.

5. The heating device for a glove as recited in claim 1, wherein the conductive wire includes a first and second end, said first and second end of the conductive wires being connected to a battery set.

6. The heating device for a glove as recited in claim 5, wherein a control mechanism is connected to the battery set for controlling electric current provided by the battery set.

7. The heating device for a glove as recited in claim 1, wherein the spaced-apart conductive wires are positioned among, and connected in series with the sheaf of highly resistant filaments.

8. The heating device for a glove as recited in claim 7, wherein the highly resistant filaments are made of carbon fiber.

9. The heating device for a glove as recited in claim 7, wherein the conductive wires include a first and second end, said first and second end of the conductive wires being connected to a battery set.

10. The heating device for a glove as recited in claim 9, wherein a control mechanism is connected to the battery set for controlling electric current provided by the battery set.

* * * * *